US006062230A

United States Patent [19]

Kajgana

[11] Patent Number: 6,062,230

[45] Date of Patent: May 16, 2000

[54] TINT BRUSH WITH COLOR DISTRIBUTOR

[76] Inventor: Zarko Kajgana, 25151 Brookpark Rd. #1616, North Olmsted, Ohio 44070

[21] Appl. No.: 09/111,598

[22] Filed: Jul. 7, 1998

[51] Int. Cl.[7] ..... A45D 24/22

[52] U.S. Cl. ..... 132/116; 132/115; 132/152; 132/151; 401/291

[58] Field of Search ..... 132/116, 112, 132/113, 114, 212, 152, 151; 215/209, 330; 409/190, 291

[56] References Cited

U.S. PATENT DOCUMENTS

| | | | |
|---|---|---|---|
| 3,204,644 | 9/1965 | McDougall-Kaley | 132/212 |
| 3,457,928 | 7/1969 | Kurshenoff | 132/114 |
| 4,143,667 | 3/1979 | Peilet | 132/116 |
| 4,209,027 | 6/1980 | Morganroth | 132/212 |
| 4,354,512 | 10/1982 | Rappatte, Jr. | 132/212 |
| 4,730,361 | 3/1988 | Koffler | 132/116 |
| 4,813,439 | 3/1989 | Morgan | 132/116 |
| 5,482,058 | 1/1996 | Garconnet | 132/116 |

*Primary Examiner*—John J. Wilson
*Assistant Examiner*—Pedro Philo Gene

[57] ABSTRACT

A tint brush with a color distributor is provided having an anatomically designed container which has an elliptical shape and is screwed onto a connection pipe with a main tinter body. The container and connection pipe are inclined relative to a vertical axis of the main tinter body, preferably, by 60 degrees. A free flow of hair dye mixture from the container is enabled by squeezing the container or by using a pump provided in the container in an alternative embodiment. A collector area defined in the main tinter body collects dye mixture wherefrom the dye mixture is distributed with the aid of a flow regulator and a plurality of radial exit bores which define, on their ends, funnel-like or shaped openings that open in tangent with a set of bristles connected to the tinter body. The flow regulator is suitably grooved so that the rate of dye mixture flowing through the main tinter body can be regulated from a minimum to a maximum amount by turning the flow regulator by 90 degrees. The flow regulator body is sealed to the main tinter body using a set of O-rings and the grooves defined in the regulator body are formed adjacent the plurality of radial exit bores so that the dye mixture flow can be controlled.

9 Claims, 14 Drawing Sheets

1
2
5
6
9
2X 1
12
8
4
2Y
3C
3
11
2
5
10X
15X
3C
2X
9

7
6
5

12
10
5
15
4
14
16
6
9
11
2
8

9
15
5
4
15X
10B
10B
6
7
16
2
54
46
48
49
50
47
1
57
55
56
51
52
59
53
58
2
16
15
4
10
3
19
18
11
6
5

7
4
15X
6
5

TINT BRUSH WITH COLOR DISTRIBUTOR

BACKGROUND OF THE INVENTION

I. Field of the Invention

The present invention is directed to the art of tint brushes and more particularly, to a tint brush that is supplied with hair color dye through a specialized color distributor. The tint brush of the invention could be used as an "all purpose" brush as well.

II. Description of Prior Art

Many beauty supply stores, department stores, and supermarkets, offer hair coloring mixtures separate and apart from tint brush color distributor devices. The tint brushes themselves are typically sold separately from the hair coloring mixtures and solutions. Often, the hair coloring is packaged with PVC gloves that are to be worn during use of the product as the hair coloring is applied. When working with hair coloring equipment of this type, it is important to carefully handle the dye because it can drip, ruining clothing and carpet alike. In addition, hair dying using the above equipment is typically very time consuming and the quality is not always satisfactory.

Presently, there are several known hair color applicators and hair color dispensers. Many of these devices have disadvantages in use and are therefore commercially limited. The applicators and dispensers typically do not provide an accurate flow of dye mixture that is to be dispensed over the head of the subject or customer. The major problems with these prior dispensers and applicators include too much dye mixture, or too little dye mixture, or both, resulting in uneven application and a resultant "streaking" of the dye mixture over the hair.

In addition to the above, many of the prior applicators and dispensers are not suitable for dying hair close to the head ("hair roots") resulting in unsatisfactory hair dying quality.

Further, in prior applicators and dispensers, it is not possible to control or to regulate the dye mixture flow to provide an even supply of the mixture.

It is therefore desirable to have a tint brush with a color distributor that can apply hair dye mixture in an even, regulated fashion, that avoids streaking and other problems associated with the prior applicators and dispensers discussed above.

SUMMARY OF THE INVENTION

In accordance with the present intention, a tint brush with a color distributor is provided including a hair color dye container adapted for threaded engagement with a tinter body. Preferably, the tinter screws onto the color distributor and includes a damper in fluid communication with the container. The damper has a plurality of radial exit holes, each of the plurality of radial exit holes having a funnel-shaped recess openings formed tangent to a set of bristles on the tinter body. The bristles are partially positioned in grooves defined in an extended portion of the tinter body.

It is a primary object of the invention to provide a tint brush than enables an even, controlled dye mixture application onto the hair of a customer or subject.

It is another object of the invention to provide a tint brush that delivers a continuous flow of dye mixture to the hair of a customer.

It is yet a further object of the invention to provide a tint brush that is easy to use thus shortening the time required for a typical application of hair coloring dye. Preferably, the tint brush shortens the time required for a typical application of hair coloring dye by 50%.

It is still yet further an object of the invention to provide a tint brush that is easy to operate and yet function better than prior distributors and applicators to improve the quality of hair dying.

It is a primary advantage of the invention that the hair color dye is delivered in a controlled, even fashion, to prevent streaks and other problems associated with over application, under application, and uneven application.

It is yet another advantage that consumers can use the tint brush of the invention alone and without the need for help from others to dye their own hair.

Still yet another advantage is that consumers can use the tint brush of the invention above without dripping or spilling the dye mixture thus avoiding stains on carpets, clothes, or the like.

These and other objects and advantages of the present invention will become apparent to those skilled in the art upon a reading and understanding of the instant specification.

BRIEF DESCRIPTION OF THE DRAWINGS

The invention may take form in certain parts and arrangements of parts, the preferred embodiments of which will be described below and shown in the accompanying drawing figures, wherein:

FIG. 4Z is a cross-sectional view of the tint brush with color distributor formed in accordance with the fourth preferred embodiment of the invention taken along line 4Z—4Z of FIG. 4A;

DETAILED DESCRIPTION OF THE PREFERRED EMBODIMENTS

Figures 1A, 1B, 1C:
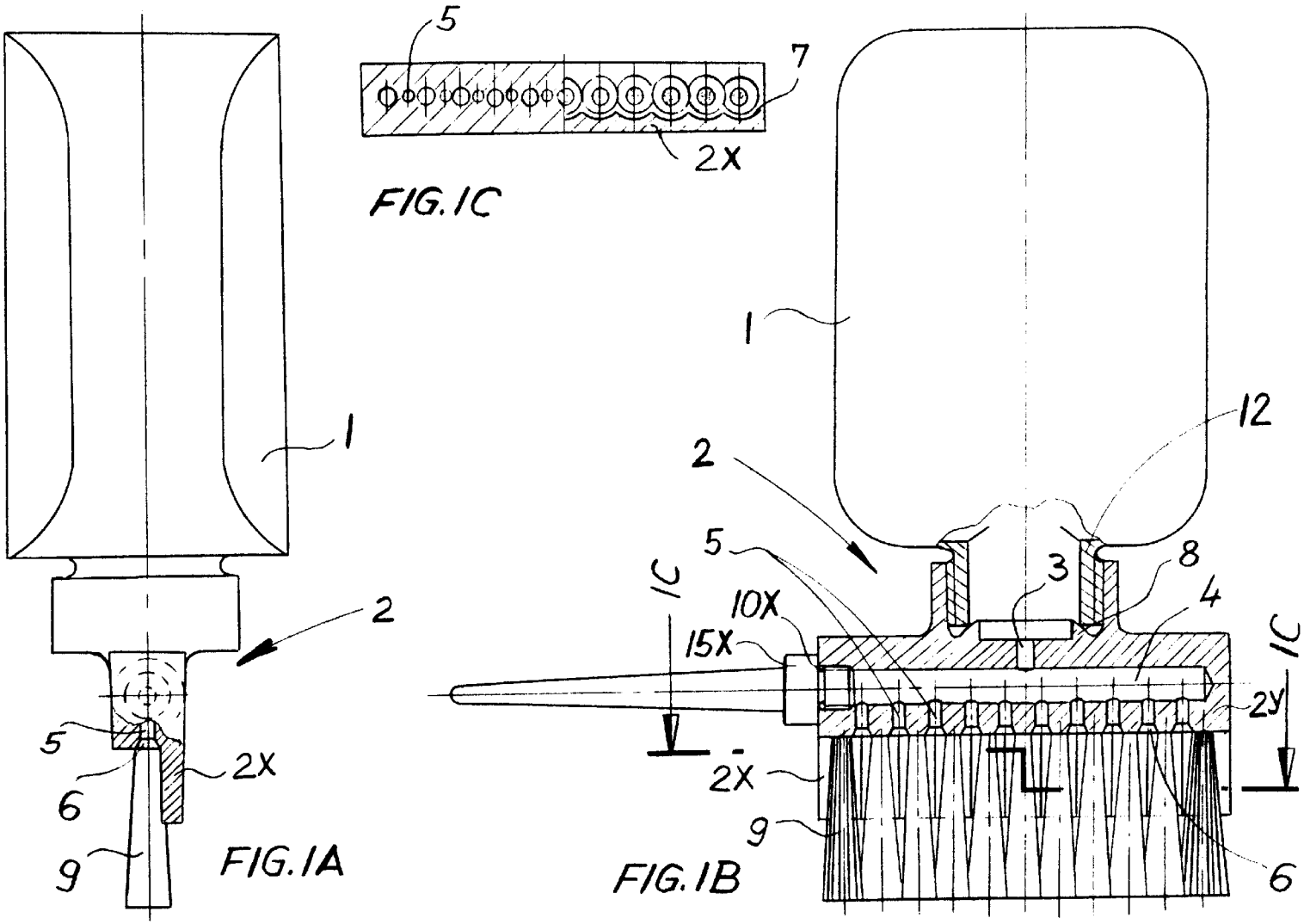
FIG. 1A is an elevational end view, in partial cross section, of a tint brush with color distributor formed in accordance with a first preferred embodiment of the invention.
FIG. 1B is an elevational side view, in partial cross section, of the tint brush with color distributor formed in accordance with the first preferred embodiment of the invention shown in FIG. 1A.
FIG. 1C is a cross-sectional view of the tint brush with color distributor formed in accordance with the first preferred embodiment of the invention taken along line 1C—1C of FIG. 1B.

Referring now to the drawings wherein the showings are for the purposes of illustrating the preferred embodiments of the invention only and not for purposes of limiting same, a tint brush with a color distributor formed in accordance with a first preferred embodiment of the invention is shown in FIG. 1A–1C. The apparatus shown there includes a reusable color mixture container 1 attached to a main tinter body 2. The reusable container 1 is preferably made out of a transparent plastic material or a semi-transparent plastic material such as, for example, PVC or Teflon, so that the hair dye mixture contained therein can be easily observed. The container 1 of FIGS. 1A and 1B is adapted to hold a cream developer which is combinable with a permanent cream colorant, preferably by shaking the mixture after the container 1 is screwed onto the tinter body 2. After the permanent cream colorant and cream developer are mixed together, the device shown in the figures is ready for use in hair dying.

During use of the subject invention, dye mixture flows from the transparent container 1 outward through a neck portion 12 and into a damper region 3 defined in a collector area 4 of the main tinter body 2. From there, the dye mixture is spread out evenly through radial exit bores 5.

An extension member 2X is provided on the main tinter body 2 and extends therefrom as shown in the Figures. The extension member 2X is provided with a plurality of grooves 7 that operate in combination with the damper region 3 to prevent hydraulic shock while squeezing the transparent container 1 and thus to assist in preventing streaking the distribution of dye mixture through the radial exit bores 5. The opens ends of the radial exit bores 5 are each provided with a funnel-shaped recess 6 that each open substantially in tangent to a plurality of sets of bristles 9. The funnel-shaped recesses 6 provided on the exit side of each of the radial exit bores 5 enable a smooth and continuous flow of dye mixture onto each of the bristles 9. Further, the grooves 7 surround the bristles 9 on one side and hold the bristles 9 in place and help to smooth and spread the dye mixtures onto the bristles 9.

A circular tooth member 8 formed on the main tinter body 2 is adapted to sealingly engage a sealing neck member 12 formed on the transparent container 1. A needle-point member 15X is mounted on the front end of the collector area 4 as shown. The plurality of sets of bristles 9 are pinched together and attached to the body of the tinter at an attachment region 2Y. The bristles 9 are used for application of the dye mixture out of the subject device and onto the head of a subject or customer. Control over the speed at which the dye mixture flows is controlled by squeezing the container 1 which, as indicated above, is preferably made of an elastic plastic material.

The plastic needle-point member 15X is adapted to be screwed onto the main body of the tinter 2 and is designed for dividing the hair tufts while dying the hair. As shown, the needle-point member 15X is sealed using an O-ring 10X.

Figure 2B:
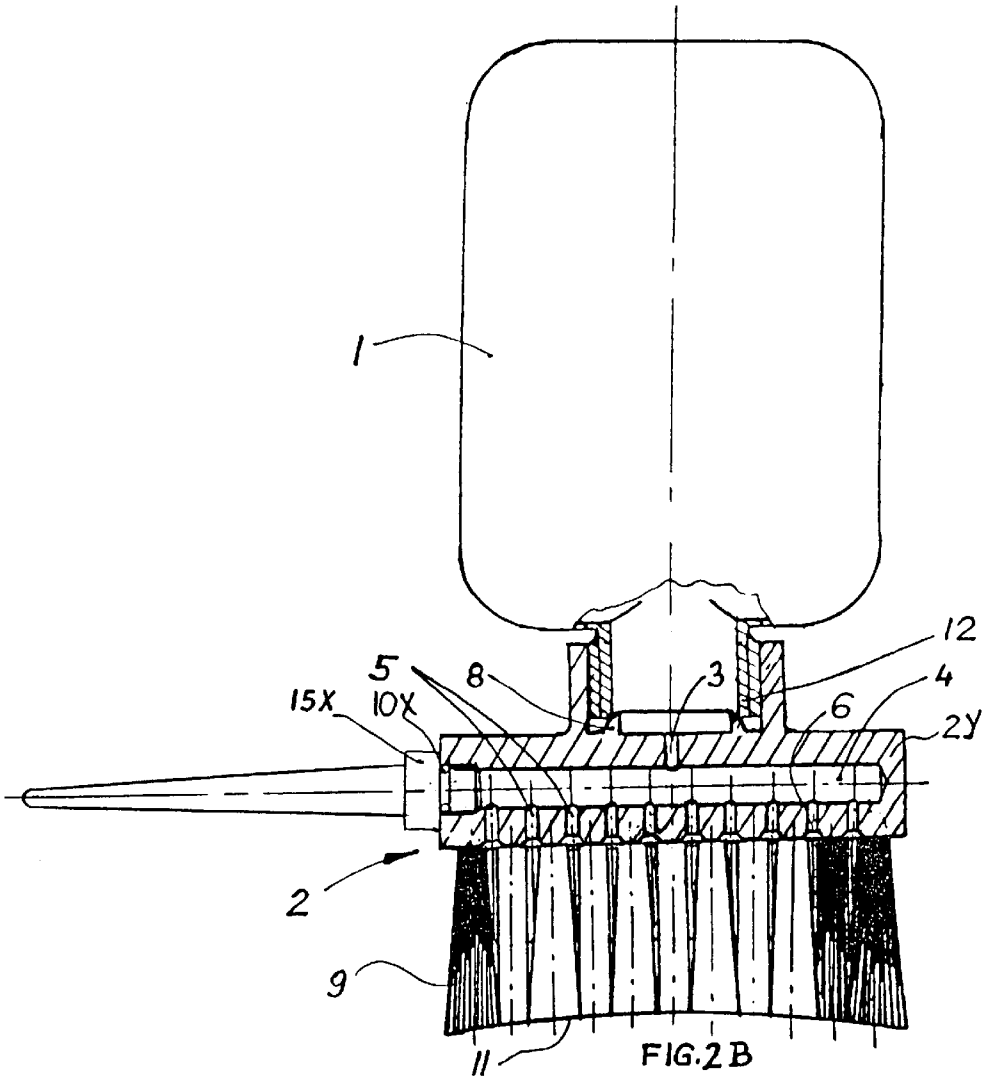
FIG. 2B is an elevational side view, in partial cross section, of the tint brush with color distributor formed in accordance with the second preferred embodiment of the invention shown in FIG. 2A.
Figure 2A:
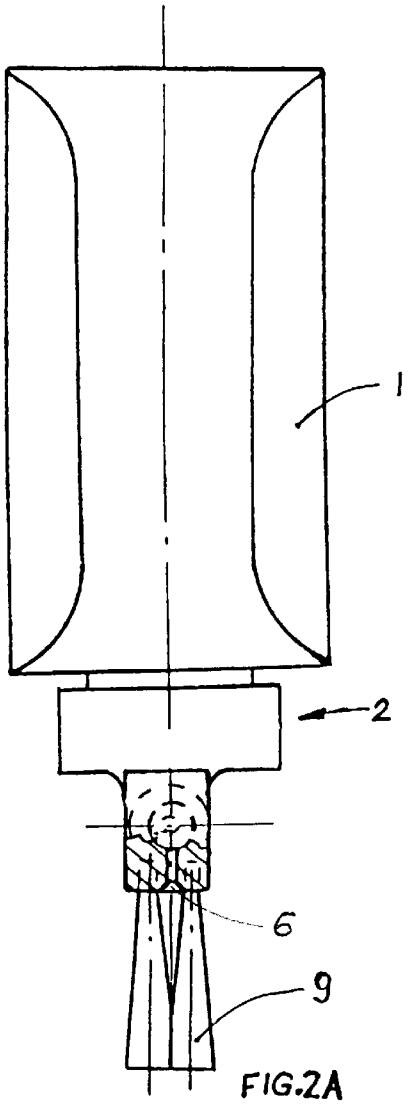
FIG. 2A is an elevational end view, in partial cross section, of a tint brush with color distributor formed in accordance with a second preferred embodiment of the invention.

Preferably, the plurality of sets of bristles 9 are formed into two rows of bristles 9 and extend from the main tinter body 2 to an extent that is fashioned to match the radius of an average human head 11 as best shown in FIG. 2B. In FIGS. 2A and 2B, the rows of bristles 9 are formed symmetrical about the vertical axis of the main tinter body and the transparent container. As shown there, in the second preferred embodiment, the plurality of grooves 7 are not provided on the main tinter body. Rather, the bristles 9 extend directly from the main tinter body. The free ends of the bristles preferably have the radius of an average human head 11 as shown.

Figures 3A, 3B, 3C:
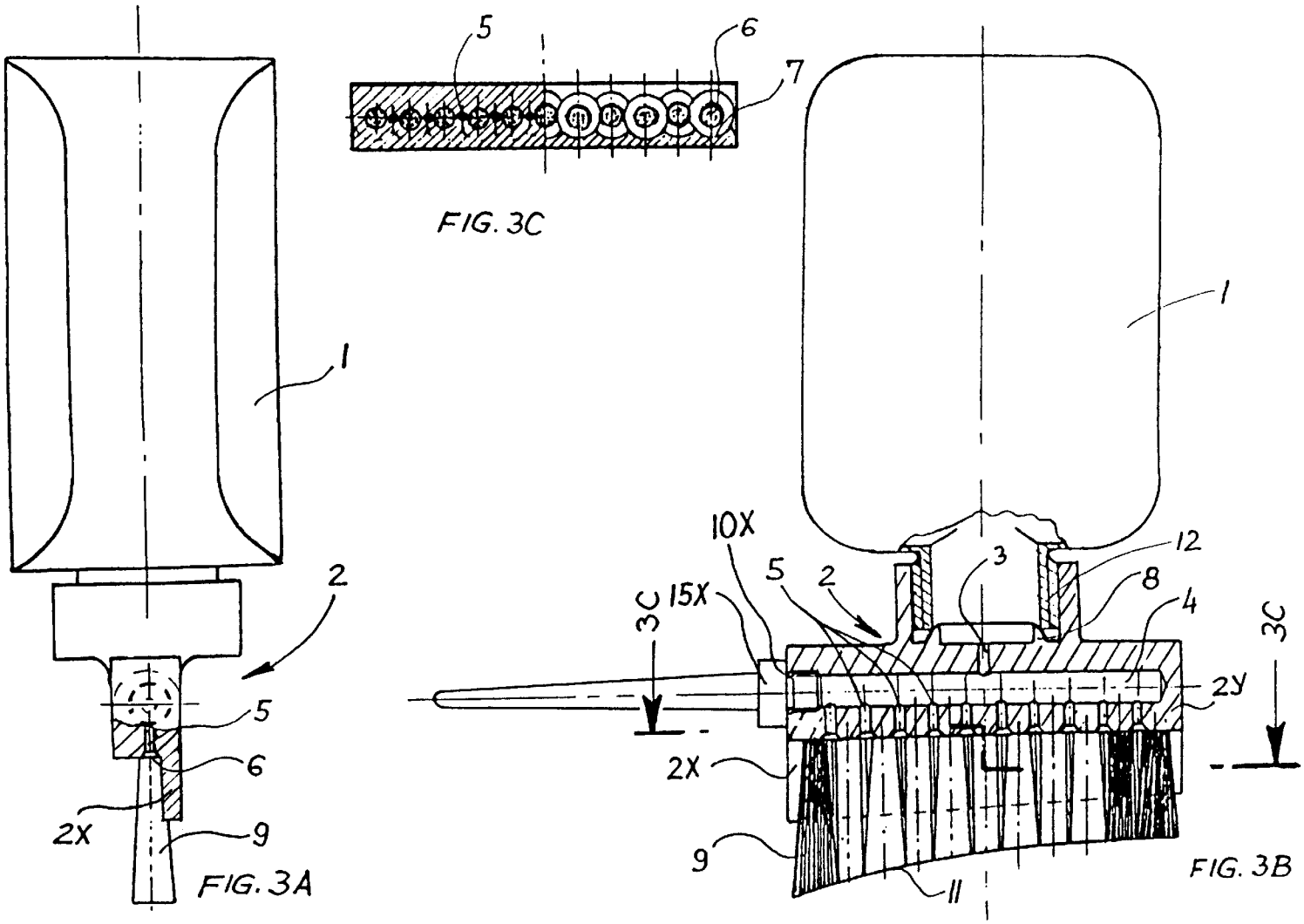
FIG. 3A is an elevational end view, in partial cross section, of a tint brush with color distributor formed in accordance with a third preferred embodiment of the invention.
FIG. 3B is an elevational side view, in partial cross section, of the tint brush with color distributor formed in accordance with the third preferred embodiment of the invention shown in FIG. 3A.
FIG. 3C is a cross-sectional view of the tint brush with color distributor formed in accordance with the third preferred embodiment of the invention taken along line 3C—3C of FIG. 3B.

The third preferred embodiment of the invention shown at FIGS. 3A–3C is analogous to the first preferred embodiment of the invention shown at FIGS. 1A–1C with the exception that the plurality of sets of bristles 9 are formed of varied lengths so that they extend from the main tinter body 2 to form or define a surface 11 which is asymmetrical with the vertical axis of the transparent container in the main tinter body.

Figure 4B:
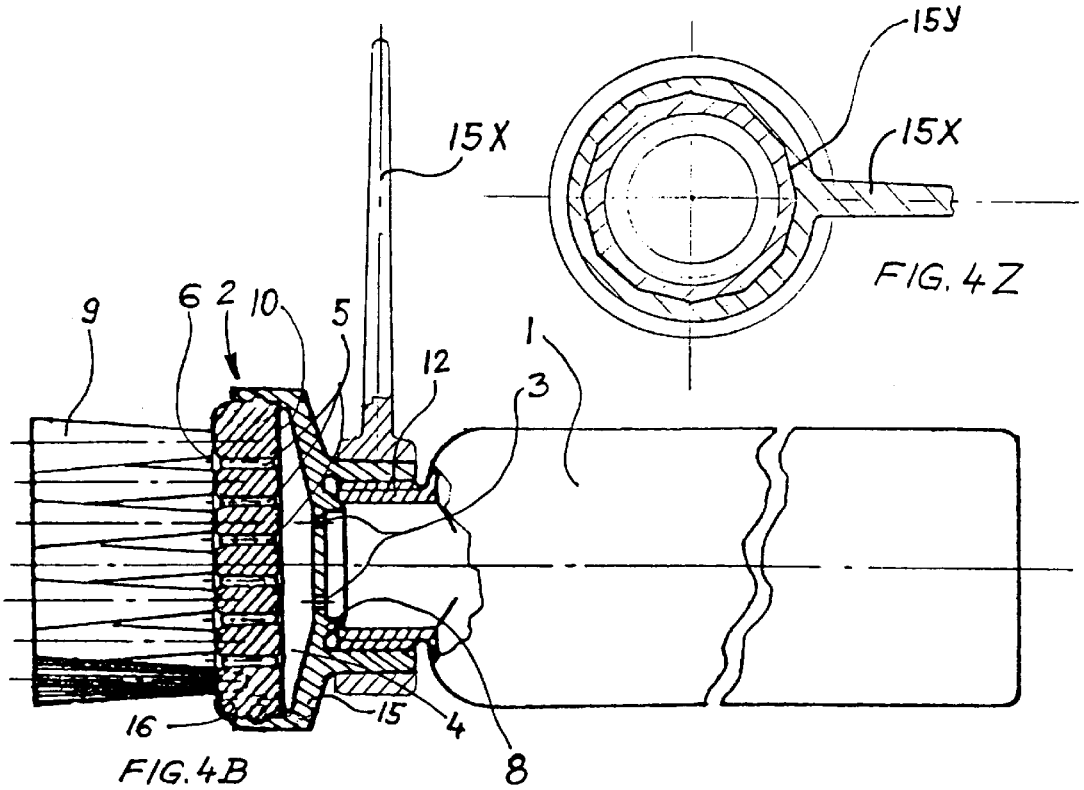
FIG. 4B is an elevational side view, in partial cross section, of the tint brush with color distributor formed in accordance with the fourth preferred embodiment of the invention.
Figure 4A:
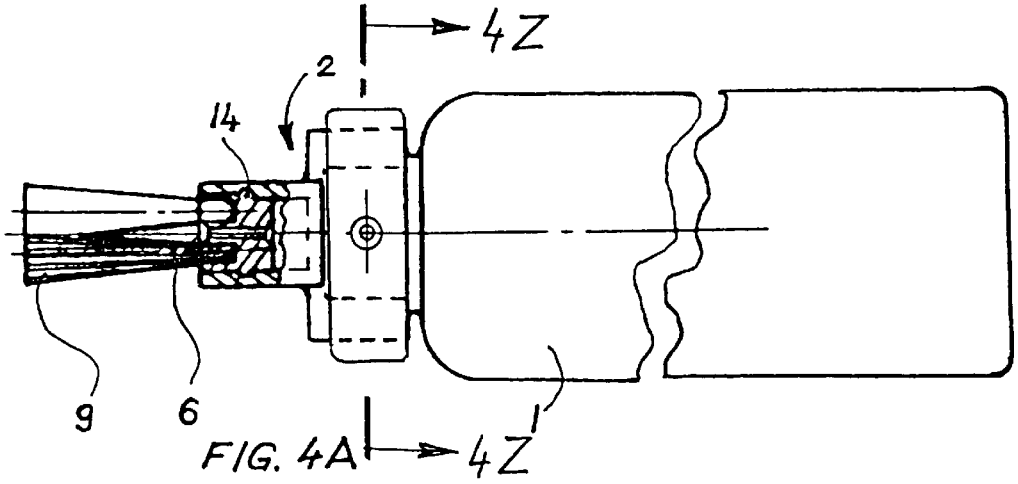
FIG. 4A is an elevational end view, in partial cross section, of a tint brush with color distributor formed in accordance with a fourth preferred embodiment of the invention.
Figure 4D:
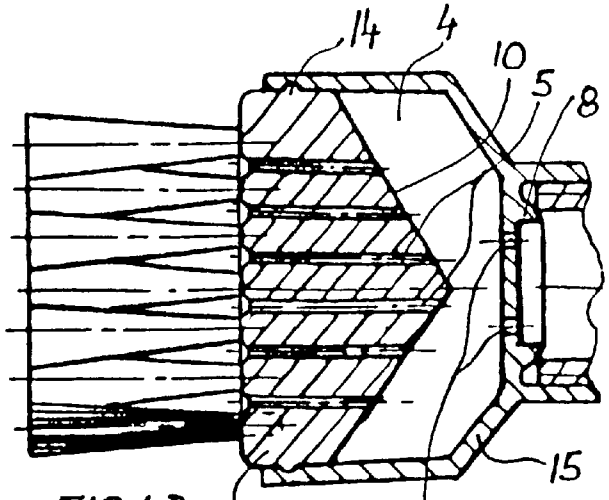
FIG. 4D is a longitudinal cross-sectional view of a tint brush with a color distributor formed in accordance with a sixth preferred embodiment of the invention illustrating a triangle-shaped surface in the tint brush body.
Figure 4C:
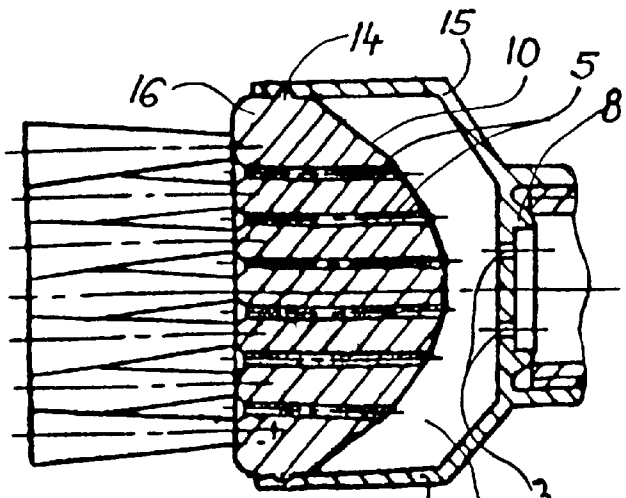
FIG. 4C is a longitudinal cross-sectional view of a tint brush with a color distributor formed in accordance with a fifth preferred embodiment of the invention illustrating a polygonal surface in the tint brush body.
Figure 4F:
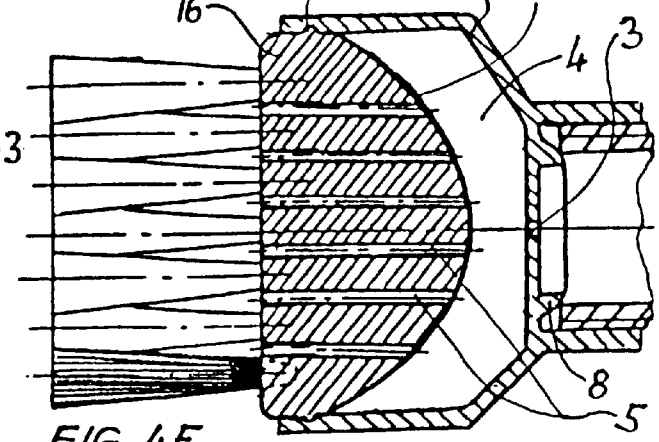
FIG. 4F is a longitudinal cross-sectional view of a tint brush with a color distributor formed in accordance with an eight preferred embodiment of the invention illustrating a parabolic surface formed in the tint brush body.
Figure 4E:
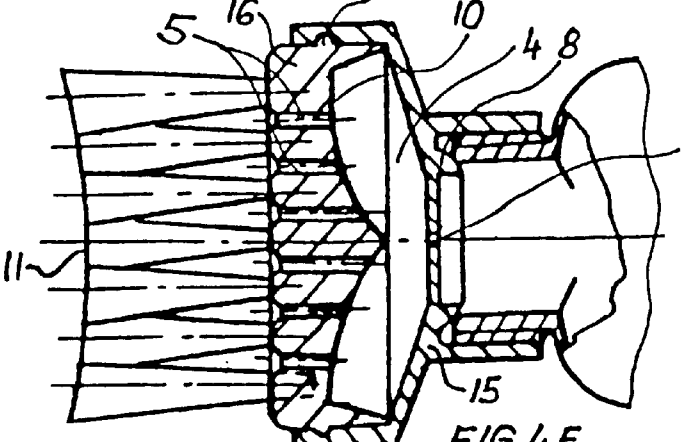
FIG. 4E is a longitudinal cross-sectional view of a tint brush with a color distributor formed in accordance with a seventh preferred embodiment of the invention illustrating a pair of bilateral parabolic surfaces formed in the tint brush body.

In FIGS. 4A–4F, the tinter 2 is similar in form and function to that described above in connection with FIGS. 1A and 1B with the exception that the collector area 4 includes an exposed surface 10 which is formed to have a substantially flat configuration as best shown in FIG. 4B. FIG. 4C illustrates the exposed surface 10 as having a convex-polygonal configuration. FIG. 4D illustrates the exposed surface as having a triangle-like shape. A convex-parabolic exposed surface shape is illustrated in FIG. 4F. Lastly, the exposed surface 10 is formed into a concave-parabolic shape as illustrated in FIG. 4E.

The above constructions and various shaped configurations of the exposed surface 10 in the tinter are provided for the purpose of enabling an even and continuous flow of dye mixture through all of the radial exit bores 5 and outwardly onto the plurality of sets of bristles 9. In the embodiments illustrated in FIGS. 4A–4E, an outer tinter element 15 is adapted to receive an inner tinter element 16 as shown best in the cross-sectional views of FIGS. 4B–4E. The inner tinter element 16 is secured relative to the outer tinter element 15 using a clutch tooth member 14.

As shown in FIGS. 4B and 4Z, a needle-point member 15X is provided on the outer tinter element 15 and includes an adjustment turn surface 15Y formed in the shape of a regular polygon. The adjustment turn surface 15Y enables adjustment of the angle of the needle-point member 15X relative to the main tinter body 2. As shown in FIGS. 4A, 4B, and 4Z, the adjustment turn surface 15Y enables rotatable movement of the needle-point member 15X relative to the main tinter body and transparent container.

Figure 5A:
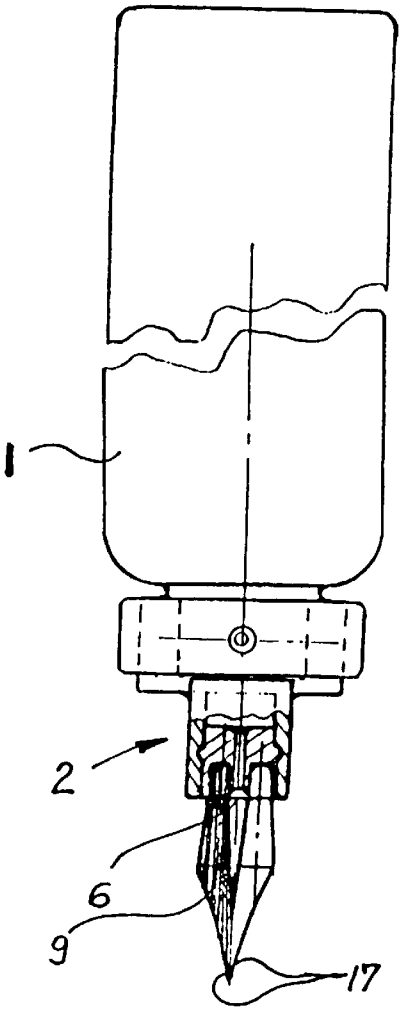
FIG. 5A is an elevational end view, in partial cross section, of a tint brush with color distributor formed in accordance with a ninth preferred embodiment of the invention.
Figure 5B:
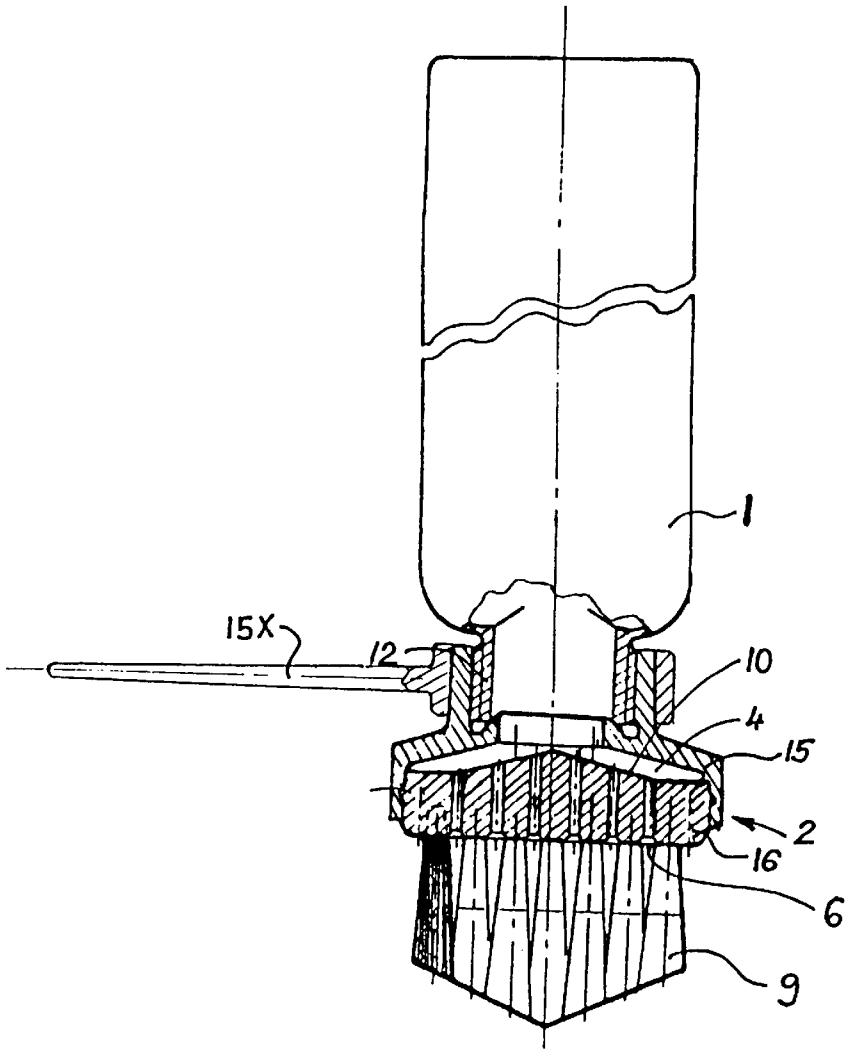
FIG. 5B is an elevational side view, in partial cross section, of the tint brush with color distributor formed in accordance with the ninth preferred embodiment of the invention illustrating a triangular-shaped exposed surface in the tint brush body.
Figures 5C, 5D, 5E:
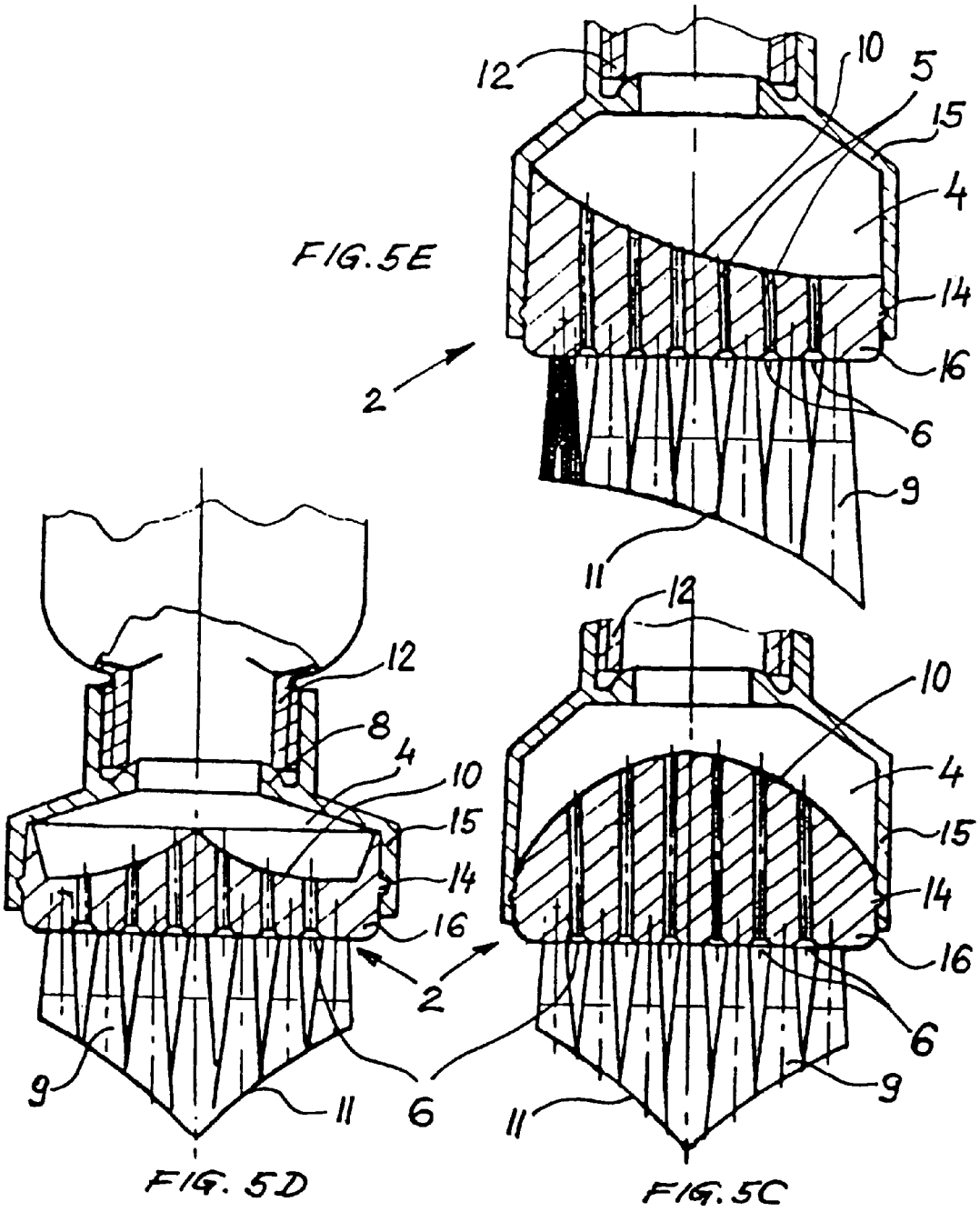
FIG. 5C is a longitudinal cross-sectional view of a tint brush with a color distributor formed in accordance with a tenth preferred embodiment of the invention illustrating a parabolic surface formed in the tint brush body.
FIG. 5D is a longitudinal cross-sectional view of a tint brush with a color distributor formed in accordance with an eleventh preferred embodiment of the invention illustrating a pair of bilateral concave-parabolic surfaces formed in the tint brush body.
FIG. 5E is a longitudinal cross-sectional view of a tint brush with a color distributor formed in accordance with a twelfth preferred embodiment of the invention illustrating a single concave parabolic surface formed in the tint brush body.

FIGS. 5A–5E illustrate a tinter 2 which is analagous to the tinter described above in connection with FIGS. 4A–4F with the exception that the main tinter body 2 is formed without the damper region 3. A plurality of sets of bristles 9 are attached to the main tinter body as shown. Each of the sets of bristles have a predetermined varied length so that they extend from the main tinter body to form an asymmetric bilateral surface 11. As shown in FIGS. 5D and 5C, the bristles 9 have varied lengths to define a lateral point. As shown in FIG. 5B, the plurality of sets of bristles 9 extend from the main tinter body to form a triangle-like surface. At FIG. 5E, the exposed surface 10 of the inner tinter element 16 has a parabolic shape and the plurality of bristles 9 define a radius 11 which is asymmetrical about the vertical axis of the tinter body.

Figures 6A, 6B, 6C:
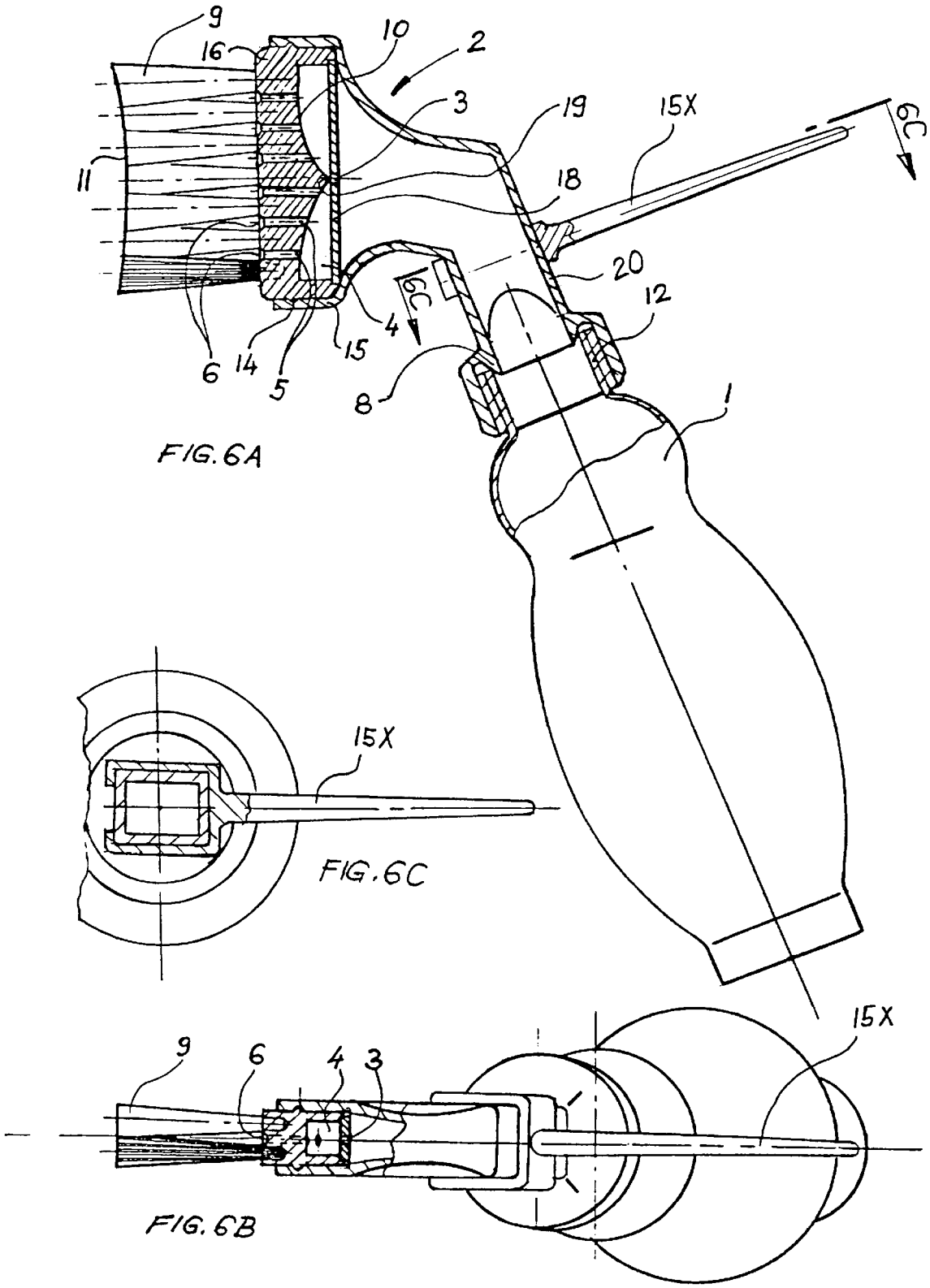
FIG. 6A is an elevational side view, in partial cross section, of a tint brush with color distributor formed in accordance with a thirteenth preferred embodiment of the invention showing the dye mixture container arranged at an angle relative to the color distributor.
FIG. 6B is an elevational end view, in partial cross section, of the tint brush with color distributor formed in accordance with the thirteenth preferred embodiment of the invention shown in FIG. 6A.
FIG. 6C is a cross-sectional view of the tint brush with color distributor formed in accordance with the thirteenth preferred embodiment of the invention taken along ling 6C—6C of FIG. 6A.

FIGS. 6A and 6B are analogous to FIG. 4E with the exception that the plurality of sets of bristles 9 are fashioned into two rows, each of the rows defining a radius 11. The tinter 2 is formed of four elements. The outer tinter element 15 defines a connection pipe 20. The connection pipe or conduit is inclined at a predefined angle, preferably about 30 degrees relative to the damper plate 18 associated with the inner tinter element 16. A damper area or region 3 is formed in the damper plate 18 at a point 19 where the pair of parabolic surfaces 10 formed on the inner tinter element 16 are joined together or meet. This allows an even flow of mixture to both be left and the right of the collector area 4.

The parabolic surfaces 10 formed on the inner tinter element 16 enable an even flow out of the dye mixture through the exit bores 5. This allows an even volume supply of dye mixture onto each of the plurality of sets of bristles 9. The transparent container 1 has an anatomical shape for better grip as shown best in FIG. 6A. Preferably, the dye container 1 is made from a transparent or semi-transparent elastic material such as, for example, PVC, Teflon, or other similar materials so that the container can be squeezed to accelerate the flow of dye mixtures out of the container and onto the set of bristles 9. A plastic needle-point member 15X is provided on the exterior of the outer tinter element 15 as best shown in FIGS. 6A–6C. The needle-point member defines an axis which is perpendicular to the axis defined by the connection pipe 20.

Figures 7A, 7B, 7C, 7D, 7E:
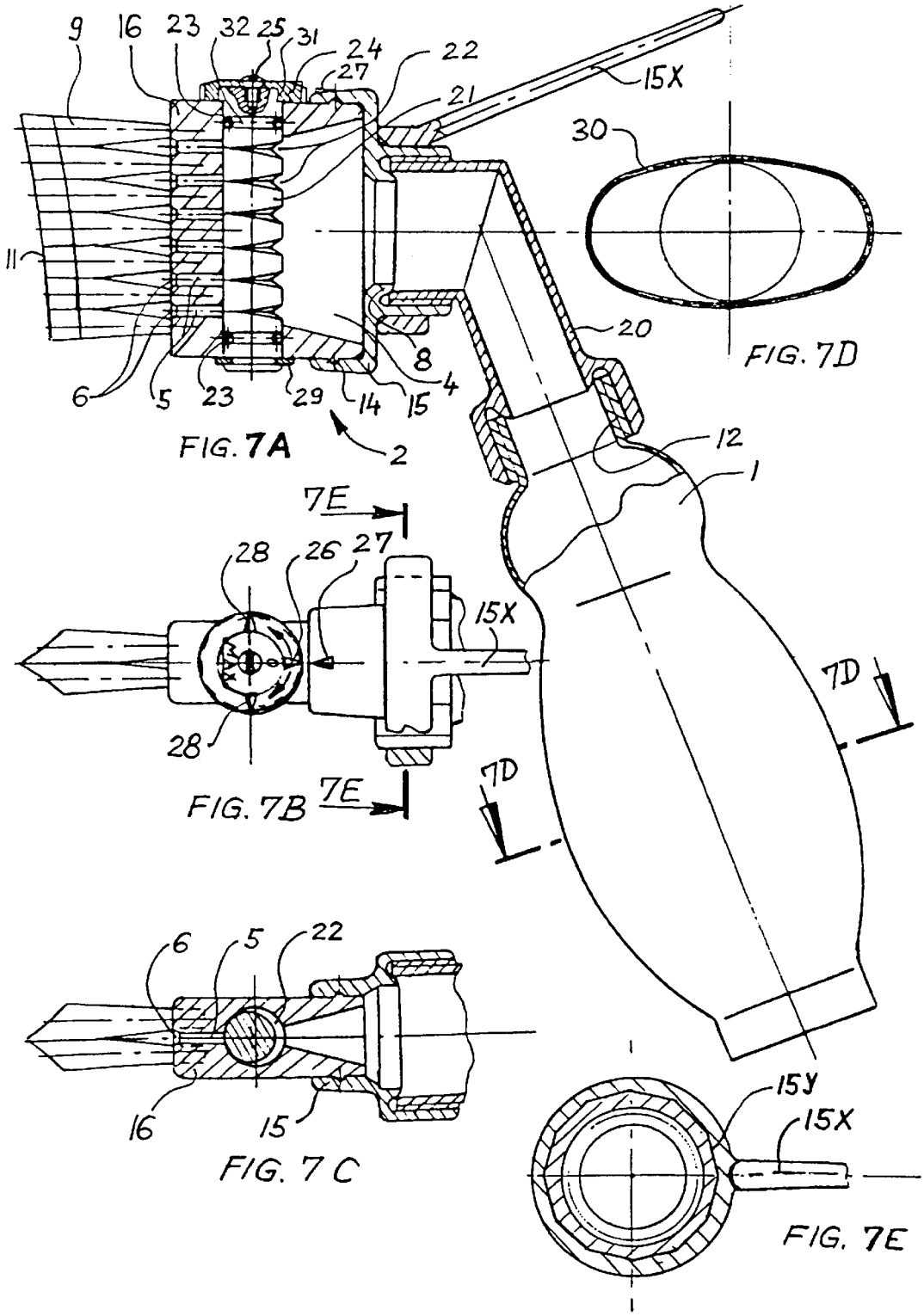
FIG. 7A is an elevational side view, in partial cross section, of a tint brush with color distributor and built-in flow regulator formed in accordance with a fourteenth preferred embodiment of the invention.
FIG. 7B is an elevational end view, in partial cross section, of the tint brush with color distributor formed in accordance with the fourteenth preferred embodiment of the invention shown in FIG. 7A.
FIG. 7C is a longitudinal cross-sectional view of the tint brush with color distributor formed in accordance with the fourteenth preferred embodiment of the invention.
FIG. 7D is a cross-sectional view of the tint brush with color distributor formed in accordance with the fourteenth preferred embodiment of the invention taken along line 7D—7D of FIG. 7A.
FIGS. 7E, 7F, and 7G are elevational and side views of the color distributor formed in accordance with the fourteenth preferred embodiment of the invention illustrating alternative bristle shapes and arrangements including a flat surface arrangement, a curved surface arrangement, and a bilateral curved surface arrangement.
Figure 7H:
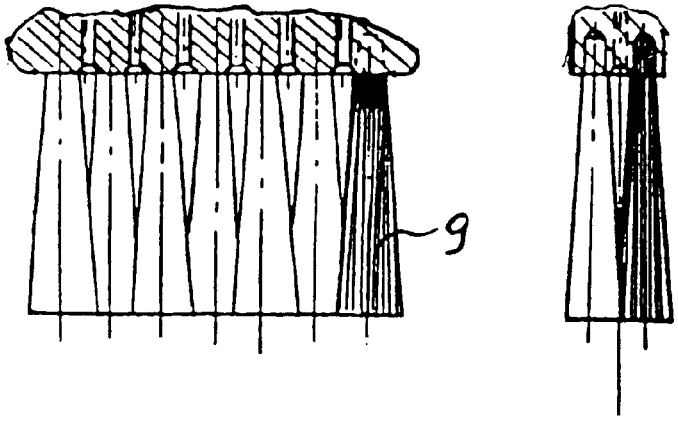
FIG. 7H is a cross-sectional view of the tint brush with color distributor formed in accordance with the fourteenth preferred embodiment of the invention.

FIGS. 7A–7G illustrate a tinter provided with a connection pipe 20 and a dye mixture container 1. The tinter shown in those figures is made of a plurality of elements including an inner tinter element 16 provided with a built-in flow regulator 21. An adjustment wheel 24 is provided in association with the built-in flow regulator 21 to enable rotatable movement of the flow regulator 21 from a position of no flow marked with a dot 26, to a position to enable maximum flow marked with a dot 28 as shown best in FIG. 7B. In the embodiment illustrated, the rate of dye mixture flowing through the radial exit bores 5 is continuously adjustable by merely turning the adjustment wheel 24. The adjustment wheel 24 can therefore be manually regulated by a consumer to provide the desired or needed dye mixture flow rate. A plurality of triangle-like radially sectioned grooves 22 are formed in the built-in flow regulator 21 as shown best in FIG. 7A. The grooves are substantially triangle-shaped and include a small surface area on one end and taper to a widened cross-sectional area to increase the flow rate to a maximum amount as shown in FIGS. 7A–7C.

One advantage of the flow regulator 21 is a proportional flow rate of the dye mixture that is enabled by continuously changing the triangle-like surfaces 21 which are each disposed adjacent a radial exit bore 5 shown best in FIG. 7A. Using this combination, an even dye mixture flow resistance is enabled so that a substantially uniform amount of dye mixture quantity is directed to each of the plurality of sets of bristles 9. The adjustment wheel 24 is preferably attached to the flow regulator body 21 using a screw 25 and is fixed with a tooth member 31 which enters into the body of the flow regulator 21.

Figure 7F:
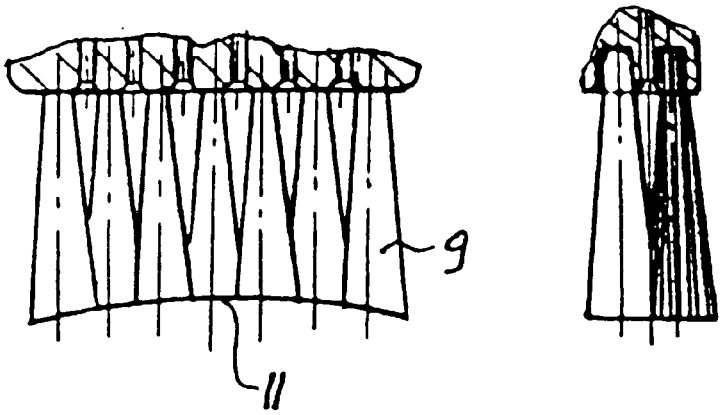
Figure 7G:
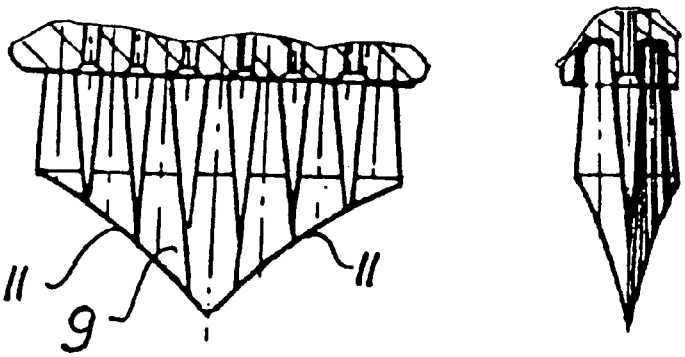

A pair of built-in O-rings 23 are disposed in grooves 32 defined in the flow regulator body 21. As shown in FIG. 7A, the inner tinter element 16 is held in place within the outer tinter element 15 using a clutch tooth member 14. The outer tinter element 15 is threadedly engaged with a connector pipe 20. A circular tooth member 8 seals the outer tinter element 15 to the connector pipe 20. As shown in FIG. 7A, the transparent dye container 1 is anatomically shaped. The container has an elliptical surface at the center for ease of handling. FIGS. 7E–7G illustrate various alternative bristle arrangements. As shown in FIG. 7E, the bristles 9 are formed to define a straight surface. FIG. 7A shows a variation in the bristles 9 which are formed to define a surface 11 which is symmetrical about the vertical axis. FIG. 7G shows yet another variation of the bristles which are formed to define a bilateral pointed surface 11.

Figure 8A:
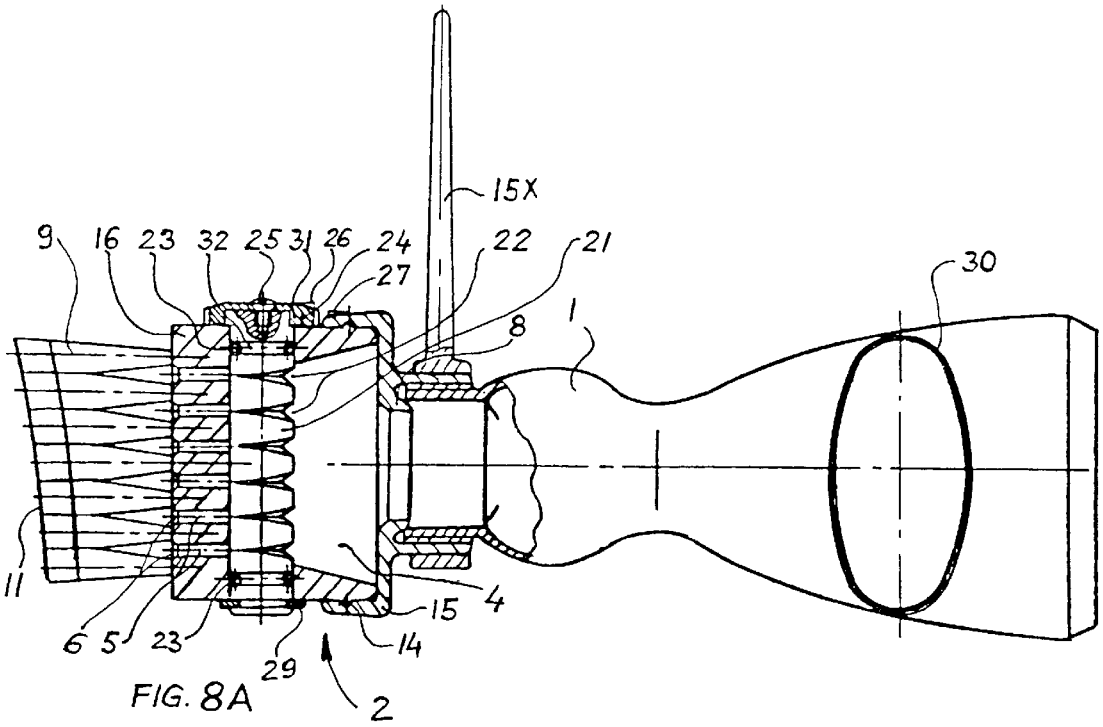
FIG. 8A is an elevational side view, in partial cross section, of a tint brush with color distributor formed in accordance with a fifteenth preferred embodiment of the invention.
Figure 8B:
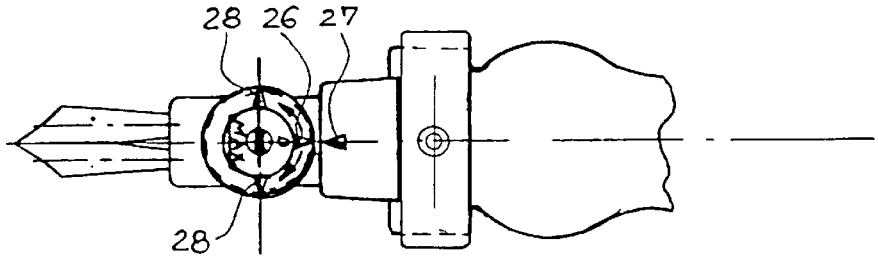
FIG. 8B is an elevational end view of the tint brush with color distributor formed in accordance with the fifteenth preferred embodiment of the invention shown in FIG. 8A.
Figure 8D:
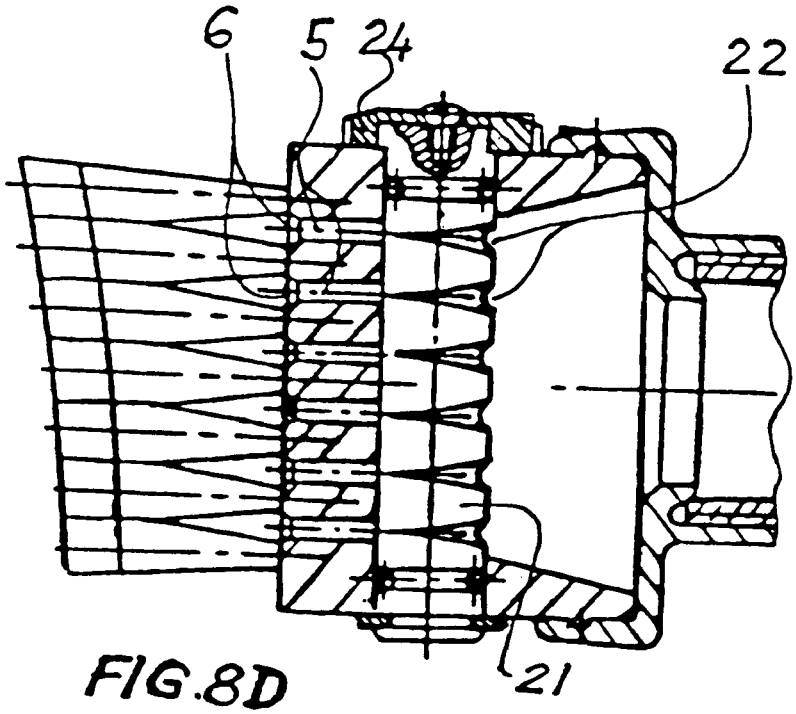
FIG. 8D is a longitudinal cross-sectional view of the tint brush with color distributor formed in accordance with the sixteenth preferred embodiment of the invention shown in FIG. 8C.
Figure 8C:
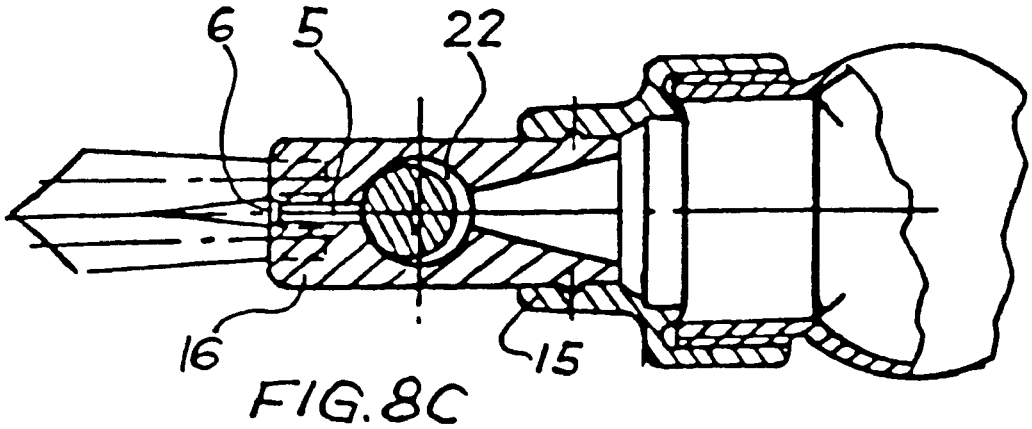
FIG. 8C is an elevation end view, in partial cross section, of a tint brush with color distributor formed in accordance with a sixteenth preferred embodiment of the invention.

FIGS. 8A–8D are analogous in form and function to the apparatus described above in connection with FIGS. 7A–7G, with the exception that the transparent container 1 is connected directly to the tinter main body 2 in a substantially vertical orientation. As shown, the container 1 is anatomically shaped for ease of use and has an elliptical radial center suction. FIG. 8D illustrates the flow regulator of the embodiment provided with grooves 22 which have curved radial cross section such as, for example, semi-rounded, elliptical, or parabolic cross sections. The grooves 22 are disposed to lie adjacent the radial exit bores 5 as shown so that the grooves overlap the exit bores so as to enable an increase or decrease in a flow of the dye mixture from the collector flow onto the bristles 9. The flow regulator 21 illustrated in FIGS. 8A–8D enable a dye mixture flow with exponential characteristics.

Figures 9A, 9B:
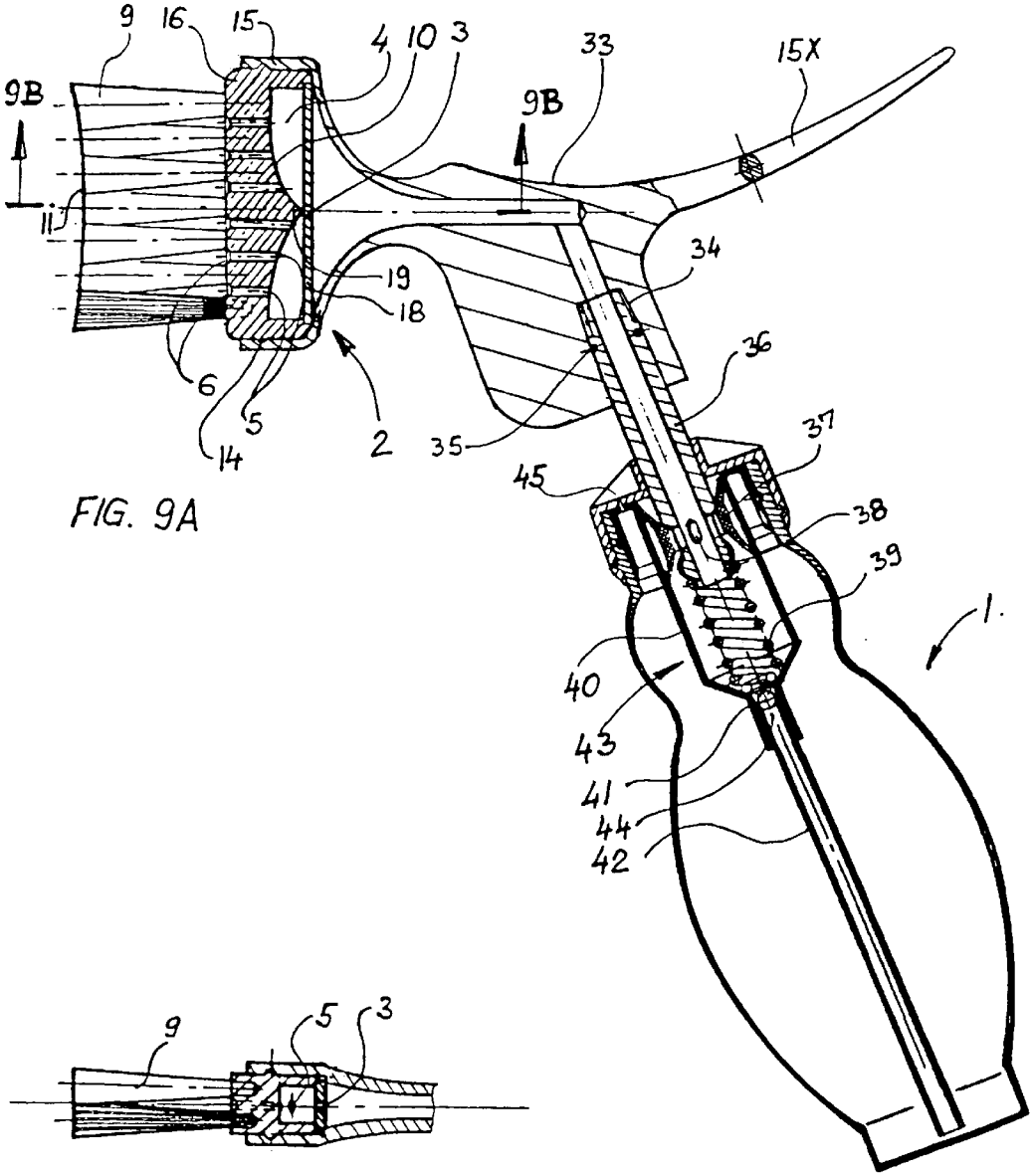
FIG. 9A is a longitudinal cross-sectional view of a tint brush with color distributor formed in accordance with a seventeenth preferred embodiment of the invention including a built-in pump mechanism.
FIG. 9B is a cross-sectional view of the tint brush with color distributor and built-in pump in accordance with the seventeenth preferred embodiment of the invention and taken along line 9B—9B of FIG. 9A.

The apparatus shown in FIGS. 9A–9B is analogous to the device shown in FIGS. 6A–6B with the exception that the outer tinter element 15 is connected to a container having a built-in pump 43. A finger depression is provided on the outer tinter element 15. In the embodiment illustrated in FIGS. 9A and 9B, by merely pressing the finger depression 33 in turn moving the pipe member 36, motion of a piston 37 is initiated within a cylinder 40 thereby closing an entranceway 44 with a ball member 41. Air that is contained within the cylinder 41 is pushed through an exit opening 38 into a collector area 4. The vacuum action of the piston urges the spring 39 back to the start position. The vacuum in the cylinder 40 pulls back on the ball 41 and the mixture is thereby urged through the pipe 42 to the cylinder 40. A small opening 45 allows atmospheric pressure to act on the contents in the cylinder 40. In the next step, the dye mixture is compressed by the piston 37 through the opening 38 and into the collector area 4 and onto the plurality of sets of bristles 9. A ball 41 closes the opening 44 which prevents mixture from backing up into the container 1. The outer tinter element 15 is connected with the pipe or conduit 36 and coil member 34 and is sealed with an O-ring 35.

Figures 10A, 10B, 10C:
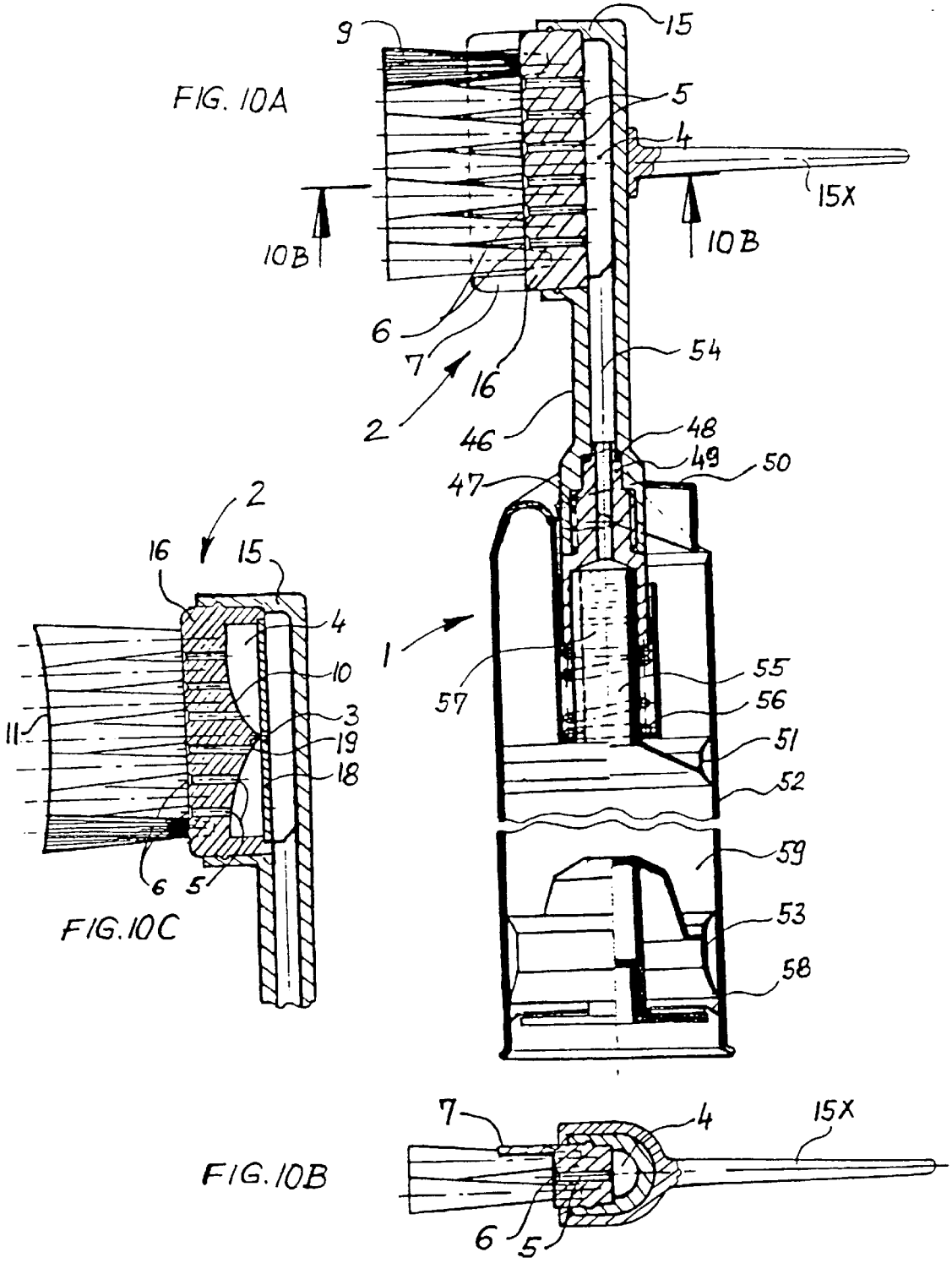
FIG. 10A is a longitudinal cross-sectional view of a tint brush with color distributor and built-in pump formed in accordance with a nineteenth preferred embodiment of the invention.
FIG. 10B is an elevational end view, in partial cross section, of the tint brush with color distributor and built-in pump mechanism formed in accordance with the nineteenth preferred embodiment of the invention; and, FIG. 10C is a longitudinal cross-sectional view of a tint brush with color distributor formed in accordance with a twentieth preferred embodiment of the invention.

FIG. 10A and 10B show a tinter apparatus similar to the device discussed above in connection with FIG. 1A–1C with the exception that the tinter body 2 is made into three parts. An inner tinter element 16 is fastened to an outer tinter element 15 using a clutch tooth member 14. The outer tinter element 15 has a cylindrical extension 46 which has, on one end, a coil member 47 which is adapted to connect with a piston region 49 of the container 1. In use of the device shown in the figures, by pressing lever 50 the piston region 49 is thereby compressed so that the piston 51 is moved within a cylinder 52 toward a free floating piston 53. The first piston 51 pushes the mixture through the extension 57 in the pipe extension member 54 and into the collector area 4 in turn through the radial exit bores 5 onto the plurality of sets of bristles 9. A spring member 56 allows the tinter to return to its start position. A piston guide member 49 is sealed using an O-ring 48. The free-floating piston 53 moves relative to the first piston 51 by pressing the lever 50. With the compression of the first piston toward the free-floating piston 53, a tapered region 58 prevents backward motion of the free-floating piston 53. During use of the device, the free-floating piston 53 is moved toward the first piston 51 until all of the mixture is used up in the cylinder 59.

Lastly, FIG. 10C shows a tinter body 2 provided with a damper region 3 that is particularly well suited for use with the apparatus shown in FIGS. 10A and 10B, in particular when the lever 50 is pressed too strongly. In that case, the damper 3 shown in FIG. 10C is adapted to stop hydraulic shock of the dye mixture when the lever 50 is pressed too strongly. The device shown in FIG. 10C is analogous in form and function to the device described above and shown in connection with FIGS. 6A and 6B. The descriptions and showings are therefore not repeated here.

The invention has been described in connection with the preferred and alternative embodiments. Alterations and modifications of the invention occur to others upon a reading and understanding of the instant application and the claims appended hereto.

I claim:

1. A tint brush with a color distributor comprising:

a tinter body;

groups of bristles extending from the tinter body;

a fluid container threaded onto the tinter body by a circular tooth formed on the tinter body which seals a neck of the container to the tinter body;

a damper defined in the tinter body and in functional connection with container to enable a flow of fluid from the container and into radial exit bores formed in the tinter body between said groups of bristles, each of the radial exit bores having a funnel shaped recess at an opening of each radial exit bore on the body, the funnel shaped recesses being tangent to said groups of bristles.

2. The tint brush with color distributor according to claim 1 wherein said groups of bristles includes at least two rows of bristles extending from the tinter body at varied lengths to define a radius of an average human head symmetrical relative to a vertical axis of the tinter body.

3. The tint brush with color distributor according to claim 1 wherein the groups of bristles extend from the tinter body at varied lengths to define a radius of an average human head asymmetrical relative to a vertical axis of the tinter body.

4. A tint brush with color distributor comprising:

a tinter body;

a plurality of sets of bristles on the tinter body;

a fluid container threaded onto the tinter body to seal a neck of the fluid container to the tinter body;

a collector area formed in the tinter body, the collector area in fluid communication with the container for enabling fluid distribution form the container through the tinter body, the collector area having an exposed surface within the tinter body which has a one of a flat-polygonal, convexo-polygonal, triangular, convexo-parabolic, and bilateral concavo-parabolic shape;

a plurality of radial exit bores formed in the tinter body for enabling fluid to flow from the collector area and out of the tinter body onto the plurality of sets of bristles, each of the plurality of sets of radial exit bores having, on an exit side thereof, a funnel shaped recess arranged in tangent to the plurality of sets of bristles of the tinters; and, a needle point member extending from the tinter body.

5. The tint brush with color distributor according to claim 4 wherein:

the exposed surface of the collector has a one of a convexo-polygonal, convexo-parabolic, concavo parabolic, and bilateral concavo parabolic shape; and, edges of the plurality of sets of bristles are formed to define a radius of an average human head in a simple symmetrical shape, a simple asymmetrical shape, a bilateral symmetrical shape, and bilateral pointed shape.

6. The tint brush with color distributor according to claim 5 wherein:

the container is connected to the tinter body with a connection pipe that has an angle relative to a vertical axis of the tinter body, the angle being substantially 60°;

the tinter body includes a damper located at the collector area at a location where two concavo surfaces are joined together;

the neck of the container is connected to the tinter body with a circular tooth;

the container is anatomically shaped; and, the tinter includes an integrated stable needle-point.

7. Tint brush with color distributor comprising:

a tinter body;

a set of bristles on the tinter body, the set of bristles extending from the tinter body at varied lengths to define a surface conforming to the shape of an average human head;

a anatomically shaped dye mixture container connected to the tinter body at an angle relative to the tinter body of substantially 60°, the container having an elliptical center radial sectional shape;

a flow regulator disposed in the tinter body, the flow regulator including a set of circumferentially extending grooves having a one of an eliptical, parabolic, and hyperbolical shape, the grooves being disposed on the flow regulator in the body in an overlapping relationship with a set of radial exit bores formed in the tinter body, the set of radial exit bores opening from the tinter body in funnel-shaped resesses arranged on the tinter body in tangent to said set of bristles, the flow regulator being sealed to the tinter body with at least two O-ring seals, which are placed in grooves formed in the flow regulator; and, a built in needle-point integrated onto the tinter body.

8. The tint brush with color distributor of claim 7 wherein the container has a non-elliptical radial section.

9. The tint brush with color distributor of claim 8 wherein said container is adapted to receive a plurality of different built in pump types.

* * * * *